US010504668B1

(12) United States Patent
Fasano

(10) Patent No.: US 10,504,668 B1
(45) Date of Patent: Dec. 10, 2019

(54) CIRCUIT BREAKER WITH SNAP ACTION CONTACTS

(71) Applicant: Carling Technologies, Inc., Plainville, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 16/055,823

(22) Filed: Aug. 6, 2018

(51) Int. Cl.

| | |
|---|---|
| ***H01H 9/34*** | (2006.01) |
| ***H01H 73/18*** | (2006.01) |
| ***H01H 83/20*** | (2006.01) |
| ***H01H 71/02*** | (2006.01) |
| *H01H 71/10* | (2006.01) |
| *H01H 1/22* | (2006.01) |

(52) U.S. Cl.
CPC ..... *H01H 9/34* (2013.01); *H01H 71/0264* (2013.01); *H01H 73/18* (2013.01); *H01H 83/20* (2013.01); *H01H 71/1009* (2013.01); *H01H 2001/223* (2013.01); *H01H 2205/034* (2013.01)

(58) Field of Classification Search
CPC ..... H01H 73/38; H01H 1/2066; H01H 1/226; H01H 2300/046; H01H 50/32; H01H 50/546; H01H 50/64; H01H 50/643; H01H 50/645; H01H 51/088; H01H 5/06; H01H 5/18; H01H 71/46; H01H 71/501; H01H 71/505; H01H 71/523; H01H 71/528; H01H 9/34; H01H 73/18; H01H 71/0264; H01H 83/20; H01H 2001/223; H01H 71/1009; H01H 2205/034
See application file for complete search history.

(56) References Cited

U.S. PATENT DOCUMENTS

| | | | | |
|---|---|---|---|---|
| 5,569,894 | A * | 10/1996 | Uchida | H01H 9/342 218/27 |
| 5,731,561 | A | 3/1998 | Manthe et al. | |
| 6,717,090 | B2 | 4/2004 | Kling et al. | |
| 2013/0118872 | A1 | 5/2013 | Fleitmann et al. | |
| 2015/0235794 | A1 * | 8/2015 | Rakuff | H01H 73/38 335/171 |

FOREIGN PATENT DOCUMENTS

| | | |
|---|---|---|
| CA | 1239959 | 8/1988 |
| EP | 2410548 | 1/2012 |
| EP | 3355334 | 8/2018 |

* cited by examiner

*Primary Examiner* — Ahmed M Saeed
(74) *Attorney, Agent, or Firm* — Forge IP, PLLC

(57) ABSTRACT

A circuit interrupter includes a stationary contact and a moveable contact disposed on a moveable contact arm, the moveable contact being configured to be pivotable into and out of physical contact with the stationary contact by pivoting of the moveable contact arm about an axis. The moveable contact arm defines a pivot angle with respect to the stationary contact as the moveable contact arm pivots about the axis. A biasing member exerts a biasing force on the moveable contact arm which pivotally biases the moveable contact toward the stationary contact when the pivot angle is less than a zero-bias angle and which pivotally biases the moveable contact away from the stationary contact when the pivot angle is greater than a zero-bias angle.

21 Claims, 3 Drawing Sheets

CIRCUIT BREAKER WITH SNAP ACTION CONTACTS

FIELD OF THE INVENTION

The present invention relates generally to the protection of electrical devices, and more specifically, relates to a circuit interrupter with snap action contacts, which provide increased speed and reliability when the contacts of the circuit interrupter are being opened and/or closed.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed meaning the contacts are physically touching and electrical current passes from one contact to the other, or open, meaning the contacts are separated relative to each other, thereby preventing the flow of electrical current therebetween. A switch may be directly manipulated by a person as a control signal to a system, such as a computer keyboard button, or to control power flow in a circuit, such as a light switch.

A second example of a circuit interrupter is a circuit breaker. A circuit breaker is generally used in an electrical panel that monitors and limits the amount of current (amperage) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line terminal and a load terminal. Generally, the line terminal is in electrical communication with a supply of incoming electricity, most often from a power company or generator. This can sometimes be referred to as the input into the circuit breaker. The load terminal, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When a circuit breaker trips, one can easily look at the electrical panel and see which breaker handle has moved to the tripped position. The circuit breaker can then be "reset" by turning the handle to the "off" position, and then moving the handle to the "on" position.

In general, a circuit breaker has two contacts located inside of a housing. The first contact is typically stationary, and may be connected to either the line terminal or the load terminal (often, the line terminal). The second contact is typically movable with respect to the first contact, such that when the circuit breaker is in the "off", or tripped position, a physical gap exists between the first and second contacts. The second contact may be connected to whichever of the line terminal or the load terminal that the first contact is not connected to (often, the second contact is connected to the load terminal).

To trip the circuit breaker so as to open the circuit, an overcurrent sensor may be provided (such as, for example, a hydraulic magnetic overcurrent sensor or a thermal overcurrent sensor) or a solenoid type trip mechanism with an overcurrent sensor may be used. When the overcurrent sensor senses a current level above a threshold level, which may, for example, be a percentage above the rated current of the circuit breaker, the overcurrent sensor or solenoid may be actuated to mechanically move the second contact away from the first contact, thereby tripping the circuit breaker to open the circuit.

A problem with a traditional circuit interrupter, however, is that even though it may be in the open position, i.e. a switch is open or a circuit breaker has tripped, interrupting the connection, the open area between the first and second contact allows an electrical arc to form between the two contacts, particularly right as the contacts are opening, or just prior to their closing. The electrical arc may have a high voltage and/or amperage, and as such can be dangerous; they can cause damage to the circuit interrupter, specifically damaging the electrical contacts, linkages or other moveable components. Any damage to the electrical contacts or other components shortens the lifespan of the circuit interrupter and affects its performance.

Another effect of arcing stems from the extremely high temperature of the arc (perhaps tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects, it has been recognized to be very important to quickly cool and quench the arc in order to prevent damage to the circuit interrupter and/or to limit the above-described dangerous situations.

There have been many proposed devices to quickly quench an arc. For example, U.S. Pat. No. 5,731,561 to Manthe et al. discloses a device with a sealed arc chamber. Inside of the sealed arc chamber is a gas designed to quench the arc that is formed when the circuit breaker trips. A disadvantage of this device is that it may be expensive to produce. The circuit breaker requires a sealed chamber, which may be expensive to manufacture and test, and also requires a specific, arc quenching, gas. The combination of the sealed chamber and the gas make this device relatively expensive. Additionally, any leaks in the chamber will cause a leak in the gas, preventing any quenching from taking place.

U.S. Pat. No. 6,717,090 to Kling et al. discloses a device with an arc splitter stack into which the arc passes via guide rails. A disadvantage of the device proposed in Kling is that it may not quench the arc as rapidly as is desired. While providing some quenching using the arc splitter, the arc splitter alone may not provide enough cooling to quickly quench the arc.

Many other references have also attempted, with varying degrees of success, to increase the rate at which arcs, once created, are quenched.

However, it may be desirable, instead of focusing on the quenching of an arc after it is created, to instead focus on reducing the magnitude and duration of arc creation to begin with. This can be accomplished, for example, by increasing the rate at which the contacts are opened or closed, particularly at the time where the contacts are still relatively close to one another (i.e., just after opening or just prior to coming into physical contact during closing). In general, the faster that the contacts can be opened or closed, the smaller the arc. Moreover, in addition to increasing the rate at which the contacts are opened or closed, it may also be desirable to increase the force with which the contacts engage one another when closed, thereby ensuring satisfactory electrical communication between the contacts.

SUMMARY OF THE INVENTION

What is desired, therefore, is a circuit interrupter that provides for the creation of arcs of reduced magnitude and/or duration as compared to known designs.

It is further desired to provide a circuit interrupter with snap action contacts, which provide increased speed and reliability when the contacts of the circuit interrupter are being opened and/or closed.

It is still further desired to provide a circuit interrupter having increased forces, as compared to known designs, with which the contacts engage one another when closed, thereby ensuring satisfactory electrical communication between the contacts.

These and other objects are achieved according to one aspect of the present invention, by provision of a circuit interrupter having a housing within which components of the circuit interrupter are contained, the circuit interrupter including a line terminal connectable to a source of electrical power, a load terminal connectable to a load, a stationary contact being mounted in a fixed fashion with respect to the housing, and a moveable contact arm having a first end and a second end, the moveable contact arm having a moveable contact positioned on the first end and being pivotably connected at the second end with respect to an axis, the moveable contact configured to be pivotable into and out of physical contact with the stationary contact by pivoting of the moveable contact arm about the axis. When the moveable contact and the stationary contact are in physical contact, the line terminal and the load terminal are in electrical communication, and when the moveable contact and the stationary contact are out of physical contact, the line terminal and the load terminal are electrically isolated from one another. The moveable contact arm defines a pivot angle with respect to the housing as the moveable contact arm pivots about the axis, and a biasing member exerts a biasing force on the moveable contact arm which pivotally biases the moveable contact toward the stationary contact when the pivot angle is less than a zero-bias angle and which pivotally biases the moveable contact away from the stationary contact when the pivot angle is greater than a zero-bias angle.

In some embodiments, the biasing member comprises a tension spring having a first end connected to a point fixed with respect to the housing and having a second end connected to the moveable contact arm. In certain of these embodiments, the zero-bias angle comprises the pivot angle of the moveable contact arm with respect to the housing wherein the point fixed with respect to the housing at which the tension spring is connected, the point at which the tension spring is connected to the moveable contact arm and the axis about which the moveable contact arm pivots all lie in a common plane.

In some embodiments, the circuit interrupter further includes a first linkage having a first end and a second end, the first end of the first linkage being pivotably connected with respect to the housing and the second end having an elongated channel formed therein, and a second linkage having a first end and a second end, the first end of the second linkage being pivotably connected with respect to the housing and the second end having a pin slideably disposed within the elongated channel formed in the first linkage, the second end of the moveable contact arm being pivotably connected to the second linkage.

In certain of these embodiments, a handle is pivotably connected to the housing, wherein actuation of the handle causes the moveable contact to be pivotable into and out of physical contact with the stationary contact by causing pivoting of the moveable contact arm about the axis about which the moveable contact arm pivots. In certain embodiments, an escapement mechanism is provided having a first end pivotably connected to the handle and a second end pivotably connected to the first linkage. In some of these embodiments, the circuit interrupter comprises a circuit breaker, and an overcurrent sensor is provided having an armature, wherein upon detection of a fault condition, the armature of the overcurrent sensor causes actuation of the escapement, thereby causing pivoting of the handle, the first linkage, the second linkage and the moveable contact arm to thereby trip the circuit breaker.

In some embodiments, an arc quenching assembly is disposed adjacent to the stationary contact and the moveable contact.

In accordance with another aspect of the present invention, a circuit interrupter is provided having a housing within which components of the circuit interrupter are contained, the circuit interrupter including a line terminal connectable to a source of electrical power, a load terminal connectable to a load, a stationary contact being mounted in a fixed fashion with respect to the housing, and a moveable contact arm having a first end and a second end, the moveable contact arm having a moveable contact positioned on the first end and being pivotably connected at the second end with respect to an axis, the moveable contact configured to be pivotable into and out of physical contact with the stationary contact by pivoting of the moveable contact arm about the axis. When the moveable contact and the stationary contact are in physical contact, the line terminal and the load terminal are in electrical communication, and when the moveable contact and the stationary contact are out of physical contact, the line terminal and the load terminal are electrically isolated from one another. A biasing member exerts a biasing force on the moveable contact arm, wherein when the moveable contact and the stationary contact are in physical contact, the biasing member biases the moveable contact toward the stationary contact, and wherein as the moveable contact arm is pivoted so as to move the moveable contact away from the stationary contact, an angular position of the contact arm is reached after which the biasing member biases the moveable contact away from the stationary contact.

In some embodiments, the biasing member comprises a tension spring having a first end connected to a point fixed with respect to the housing and having a second end connected to the moveable contact arm. In certain of these embodiments, the angular position of the contact arm after which the biasing member biases the moveable contact away from the stationary contact as the moveable contact arm is pivoted so as to move the moveable contact away from the stationary contact comprises a zero-bias angle. In certain of these embodiments, the zero-bias angle comprises the pivot angle of the moveable contact arm with respect to the housing wherein the point fixed with respect to the housing at which the tension spring is connected, the point at which the tension spring is connected to the moveable contact arm and the axis about which the moveable contact arm pivots all lie in a common plane.

In accordance with a further aspect of the present invention, a circuit interrupter includes a stationary contact and a moveable contact disposed on a moveable contact arm, the moveable contact being configured to be pivotable into and out of physical contact with the stationary contact by pivoting of the moveable contact arm about an axis. The moveable contact arm defines a pivot angle with respect to the stationary contact as the moveable contact arm pivots about the axis. A biasing member exerts a biasing force on the moveable contact arm which pivotally biases the moveable contact toward the stationary contact when the pivot angle is less than a zero-bias angle and which pivotally biases the moveable contact away from the stationary contact when the pivot angle is greater than a zero-bias angle.

Other objects of the invention and its particular features and advantages will become more apparent from consideration of the following drawings and accompanying detailed description.

DETAILED DESCRIPTION OF THE INVENTION

Figure 1:
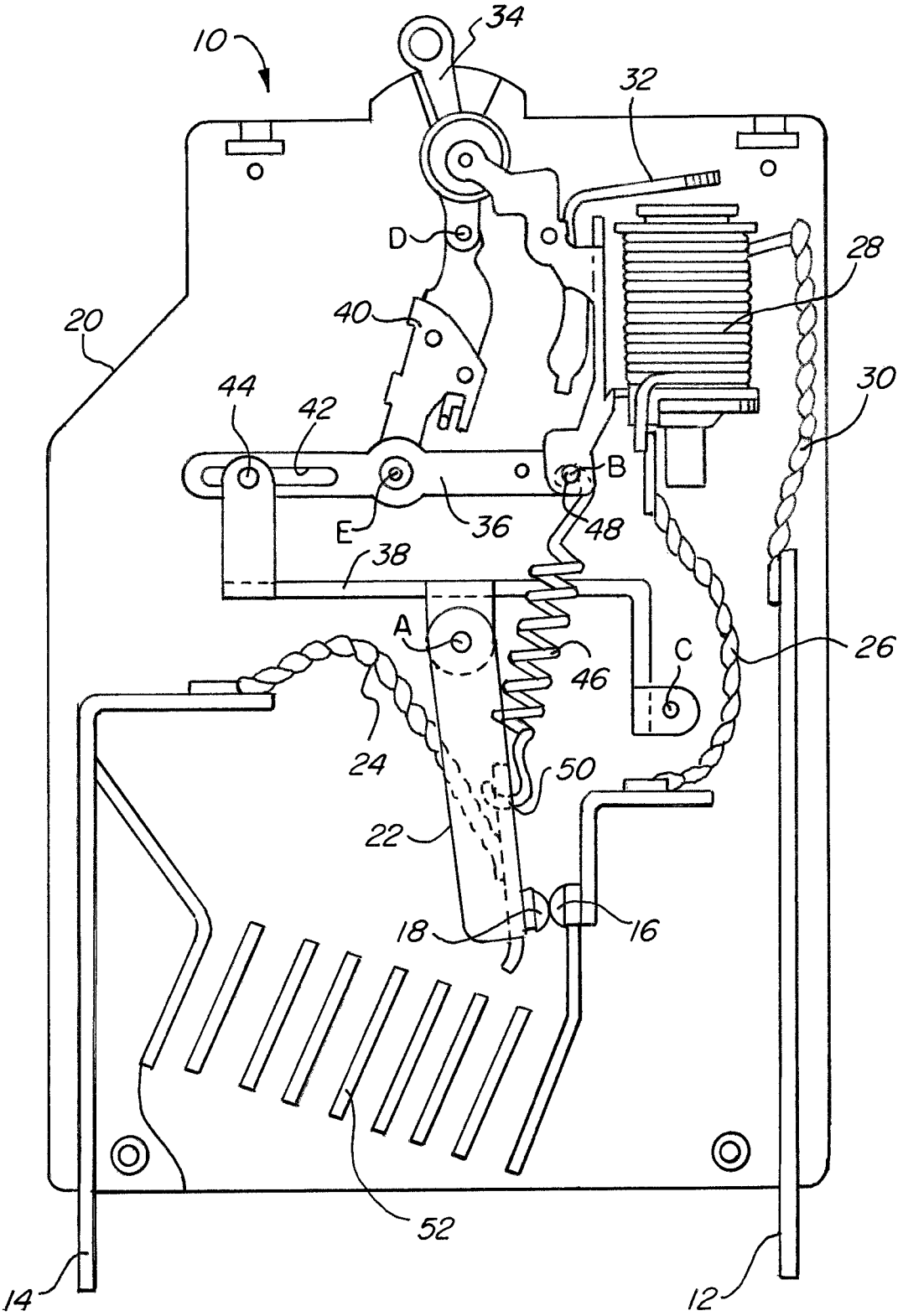
FIG. 1. is a partially cross-sectional side view of a circuit breaker according to an exemplary embodiment of the present invention shown with its contacts in a closed, non-tripped state, and shown in a configuration particularly adapted for use in a DIN-rail mount panel.

The exemplary embodiments of the present invention may be further understood with reference to the following description and the related appended drawings, wherein like elements are provided with the same reference numerals.

The exemplary embodiments of the present invention are related to circuit interrupting devices capable of opening an electrical circuit rapidly and forcefully in the event of a fault or overcurrent condition or in the case that an actuation "off" is commanded. Similarly, the interrupting devices of the exemplary embodiments are also capable of closing an electrical circuit rapidly in the event of resetting a tripped breaker or in the case that a manual actuation "on" is desired. Thereby, the magnitude and/or duration of any arcs created between the opening and/or closing contacts can be kept relatively low, and good physical and electrical contact can be ensured when the contacts are closed.

Figure 2:
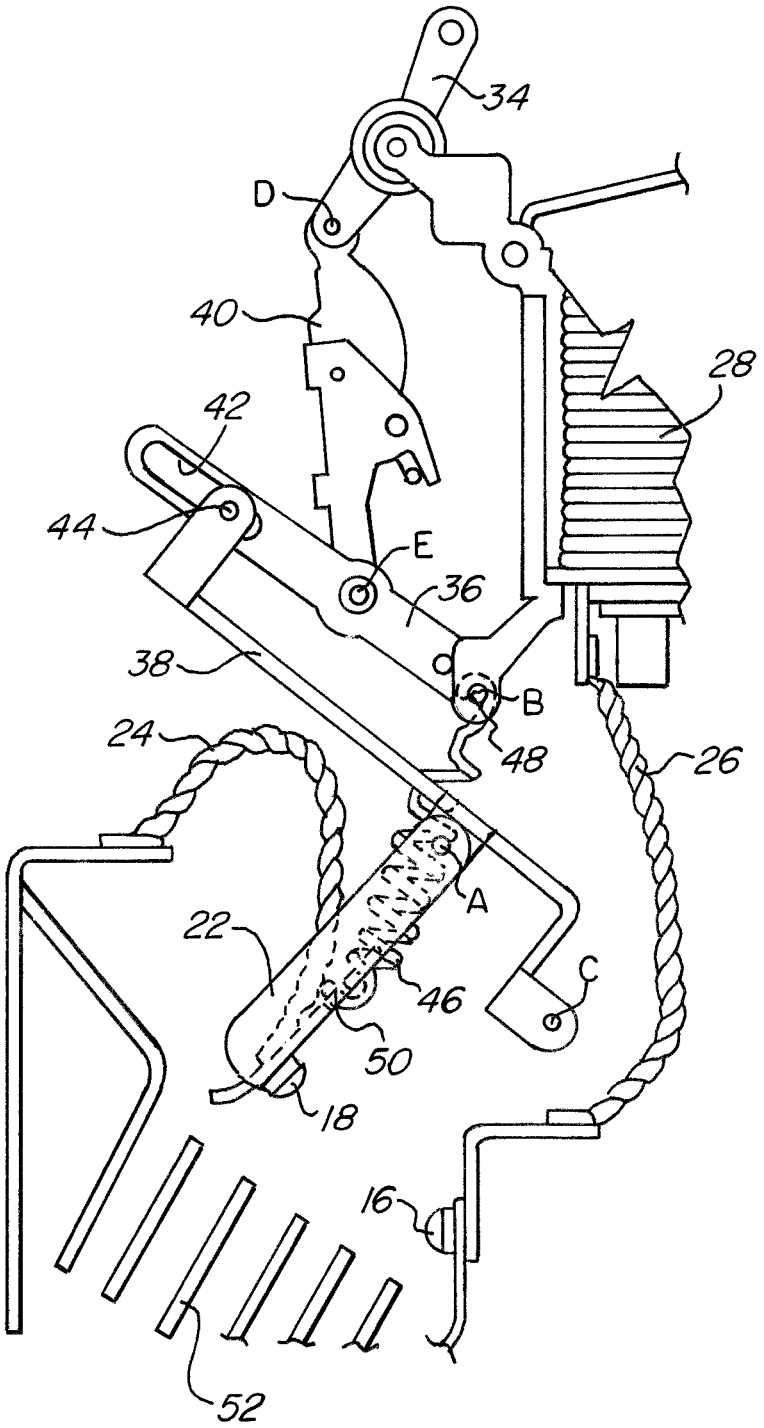
FIG. 2. is a partially cross-sectional side view of portions of the circuit breaker of FIG. 1 shown with its contacts in an open, tripped state.

More specifically, two exemplary embodiments of the inventive circuit interrupting device are shown and described herein. FIGS. 1 and 2 specifically relate to a circuit breaker (10) having a configuration particularly adapted for use in a DIN-rail mount panel, while FIG. 3 relates to a circuit breaker (10') particularly designed for use in a front mount panel. While the specific details of some elements of the circuit breakers (10,10') may differ from each other to accommodate differences in the two types of panels in which they are adapted to be mounted (as explained more fully below), the two exemplary embodiments are configured and operate in very similar fashion with respect to the basic functionality thereof.

Additionally, it should be recognized that the exemplary embodiments are described with reference to a circuit breaker, but those skilled in the art will understand that the present invention may be implemented in connection with any electrical device that has electrical contacts that can be opened and closed.

Turning now to FIG. 1, the exemplary circuit breaker (10) according to one embodiment of the present invention, particularly configured for use in a DIN-rail mount panel, is shown in the closed position. The circuit breaker (10) can be used in any commercial or non-commercial application, and may be designed to replace current circuit breakers without the need to modify existing equipment. The circuit breaker (10) is designed to trip/open and/or reset/close more quickly and forcefully than traditional circuit breakers, and is therefore better adapted to protect a circuit and equipment connected thereto than traditional circuit breakers in various applications.

Electrical current flows into the circuit breaker (10) through a first terminal (12). The first terminal (12), which may be referred to as the line terminal (connected to the source of electrical power), is electrically connected to a first contact (16). The first contact (16) remains stationary and may be attached to the housing (20) of the circuit breaker (10). A second terminal (14) may be electrically connected to a load that receives the electrical power passing through the circuit breaker (10), and may therefore be referred to as a load terminal.

In a closed position, a second contact (18), which is electrically connected to the second terminal (14), is in electrical communication with the first contact (16). In this example, the second contact (18) is movable relative to first contact (16), however, one of skill in the art would understand that either the first contact (16) or the second contact (18) or both could be moveable with respect to the other. During normal operation, when the contacts (16,18) are in the closed position, the first contact (16) and the second contact (18) physically contact each other to create a closed circuit between the line (power) and the load (equipment receiving the power) so that electrical current flows between the terminals (12,14).

If there is an overcurrent condition (i.e., a short in the circuit), the circuit breaker (10) is designed to automatically trip, causing the second contact (18) to separate from the first contact (16) thereby opening the electrical circuit.

More specifically, the moveable contact (18) is mounted toward one end of a moveable contact arm (22), which is pivotably connected, toward the opposite end, to be pivotable with respect to an axis (A). In this way, the moveable contact arm (22) is connected such that the moveable contact (18) is pivotable into and out of physical contact with stationary contact (16) by pivoting of the moveable contact arm (22) about the axis (A).

The moveable contact (18) is in electrical communication with the load terminal (14) via a conductor (24) connected therebetween. The stationary contact (16) is in electrical communication, via a conductor (26), with an overcurrent mechanism (28), which in turn is in electrical communication, via a conductor (30), with the line terminal (12). Thus, when the contacts (16,18) are in the closed state (shown in FIG. 1), electricity flows from the line terminal (12), through conductor (30), overcurrent mechanism (28), conductor (26), stationary contact (16), moveable contact (18), and conductor (24) to load terminal (14). On the other hand, when the contacts (16,18) are in the open state (shown in FIG. 2), the line terminal (12) and the load terminal (14) are electrically isolated from one another.

The overcurrent sensor (28) may take any of various forms, although in the embodiment shown, it takes the form of a hydraulic-magnetic overcurrent sensor (28) having an armature (32). Upon sensing an overcurrent or other type of fault situation, the armature (32) of the overcurrent sensor (28) acts upon a linkage assembly (described more fully below) to trip the circuit breaker (10), thereby causing the moveable contact arm (22) to pivot the moveable contact (18) out of physical contact with the stationary contact (16).

A handle (34) is pivotably connected to the housing (20) such that a portion thereof extends from the housing (20) for manipulation by an operator and/or by a solenoid (as is known in the art). The handle (34) also cooperates, as do the previously mentioned armature (32) and the moveable contact arm (22), with the previously mentioned linkage mechanism, in order to provide automatic tripping of the breaker in overcurrent or other fault situations, resetting of a tripped breaker, and commanded on/off operation.

Turning now to the linkage mechanism operably connected between the handle (34), the armature (32) of the overcurrent sensor (28) and the moveable contact arm (22), this mechanism generally comprises a first linkage (36), a second linkage (38) and a third linkage, which is generally referred to in the art as an escapement mechanism (40).

A first end of the first linkage (36) is pivotably connected with respect to the housing (20) at an axis (B), with a second end thereof having an elongated channel (42) formed therein.

The second linkage (38) has a first end that is pivotably connected with respect to said housing (20) at an axis (C), which is offset from axis (B) about which the first linkage (36) pivots. A second end of the second linkage (38) has a pin (44) disposed thereon, which pin (44) is slideably disposed within the elongated channel (42) formed in the first linkage (36). This pin/channel (44/42) arrangement allows the first linkage (36) and the second linkage (38) to interact with each other at the second end of each linkage, while also allowing them to simultaneously pivot about the two different axes (B,C).

The axis (A) about which the moveable contact arm (22) pivots is disposed on the second linkage (38). This allows all three of the first linkage (36), the second linkage (38) and the moveable contact arm (22) to interact with each other in the snap-action fashion as described more fully below. In the particular embodiment shown in FIGS. 1 and 2, the axis (A) about which the moveable contact arm (22) pivots is positioned on the second linkage (38) generally at a point disposed between the axis (C) about which the second linkage (38) pivots and the pin (44).

The escapement mechanism (40) has a first end pivotably connected to the handle (34) at an axis point (D) and a second end pivotably connected to the first linkage (36) at an axis point (E).

When the circuit breaker (10) is in a closed (i.e., "on") state, as shown in FIG. 1, the armature (32) of the overcurrent sensor (28) cooperates with the escapement mechanism (40) to "pop" the escapement mechanism toward the left (with respect to the orientation shown in the Figures) in an overcurrent situation in order to cause the rest of the linkage mechanism to pivot the moveable contact arm (22) in a clockwise fashion (again with respect to the orientation shown in the Figures) to move the moveable contact (18) away from the stationary contact (16) to the open (i.e., "off") state shown in FIG. 2.

When the circuit breaker (10) is in the open (i.e., "off") state, as shown in FIG. 2, and the handle (34) is actuated to reset or turn on the breaker (10), the escapement mechanism (40) causes the rest of the linkage mechanism to pivot the moveable contact arm (22) in a counterclockwise fashion (again with respect to the orientation shown in the Figures) to move the moveable contact (18) toward the stationary contact (16) to the closed (i.e., "on") state shown in FIG. 1. After the contacts (16,18) are closed, the escapement "pops" back into the engaged position as shown in FIG. 1 to keep the contacts in the closed (i.e., "on") state.

As will be recognized by those skilled in the art, the moveable contact arm (22) defines a pivot angle with respect to the housing (20) as the moveable contact arm (22) pivots about the axis (A) and also as the second linkage (38), which carries the pivot axis (A), pivots about the axis (B). For example, with respect to the configuration shown in FIGS. 1 and 2, the moveable contact arm (22) defines a pivot angle of about 85 degrees clockwise from zero horizontal when in the closed (i.e., "on") state shown in FIG. 1, while the moveable contact arm (22) defines a pivot angle of about 145 degrees clockwise from the same zero horizontal when in the open (i.e., "off") state shown in FIG. 2.

A biasing member (46) exerts a biasing force on the moveable contact arm (22) which pivotally biases the moveable contact (18) toward the stationary contact (16) when the moveable contact (18) and said stationary contact (16) are in physical contact (i.e., are in the closed state), as shown in FIG. 1. In the embodiment shown, the biasing member (46) takes the form of a tension spring having a first end connected to a point fixed (48) with respect to the housing (20) and having a second end connected to the moveable contact arm (22) at a point (50) thereon. More specifically, in the embodiment shown in FIGS. 1 and 2, the point (48) at which the tension spring is connected with respect to the housing (20) falls on axis (B) about which the first linkage (36) pivots, although such is not necessary.

As will be recognized by those skilled in the art, the biasing member (46), the linkages (36,38) and the moveable contact arm (22) are configured such that an angular position of the contact arm (22) is reached, after which the biasing member (46) begins biasing the moveable contact (18) away from the stationary contact (16) instead of toward it. At this angle, which may be referred to as the "zero-bias angle", there would be no bias in either rotational direction, with all of the forces generated by the biasing member being generally parallel to the moveable contact arm (22), thereby resulting in compression forces felt by the moveable contact arm (22), and there being no forces tending to bias the moveable contact arm in either the clockwise or counterclockwise direction.

This zero-bias angle may be reached when the pivot angle of the moveable contact arm (22) with respect to the housing (20) is such that the point (48) fixed with respect to the housing (20) at which the biasing member (46) is connected, the point (50) at which the biasing member (46) is connected to the moveable contact arm (22) and the axis (A) about which the moveable contact arm (22) pivots all lie in a common plane. This zero-bias angle will lie somewhere between the angle of the moveable contact arm (22) when the contacts (16,18) are in the closed (i.e., "on") state shown in FIG. 1 (i.e., about 85 degrees clockwise from zero horizontal) and the angle of the moveable contact arm (22) when the contacts (16,18) are in the open (i.e., "off) state shown in FIG. 2 (i.e., about 145 degrees clockwise from the same zero horizontal). For example, the zero-bias angle may occur at about 115 degrees clockwise from the zero horizontal, although this angle may vary.

Thus, the biasing of the moveable contact arm (22) provides for an increased rate at which the contacts are opened or closed, particularly at the time where the contacts are still relatively close to one another (i.e., just after opening or just prior to coming into contact during closing). This results in an arc with a reduced magnitude and/or duration than would be provided without the biasing. Nevertheless, arcing may not be completely prevented, such that an arc quenching assembly, for example, comprising a plurality of arc splitting plates (52), may be provided, as is known in the art.

Figure 3:
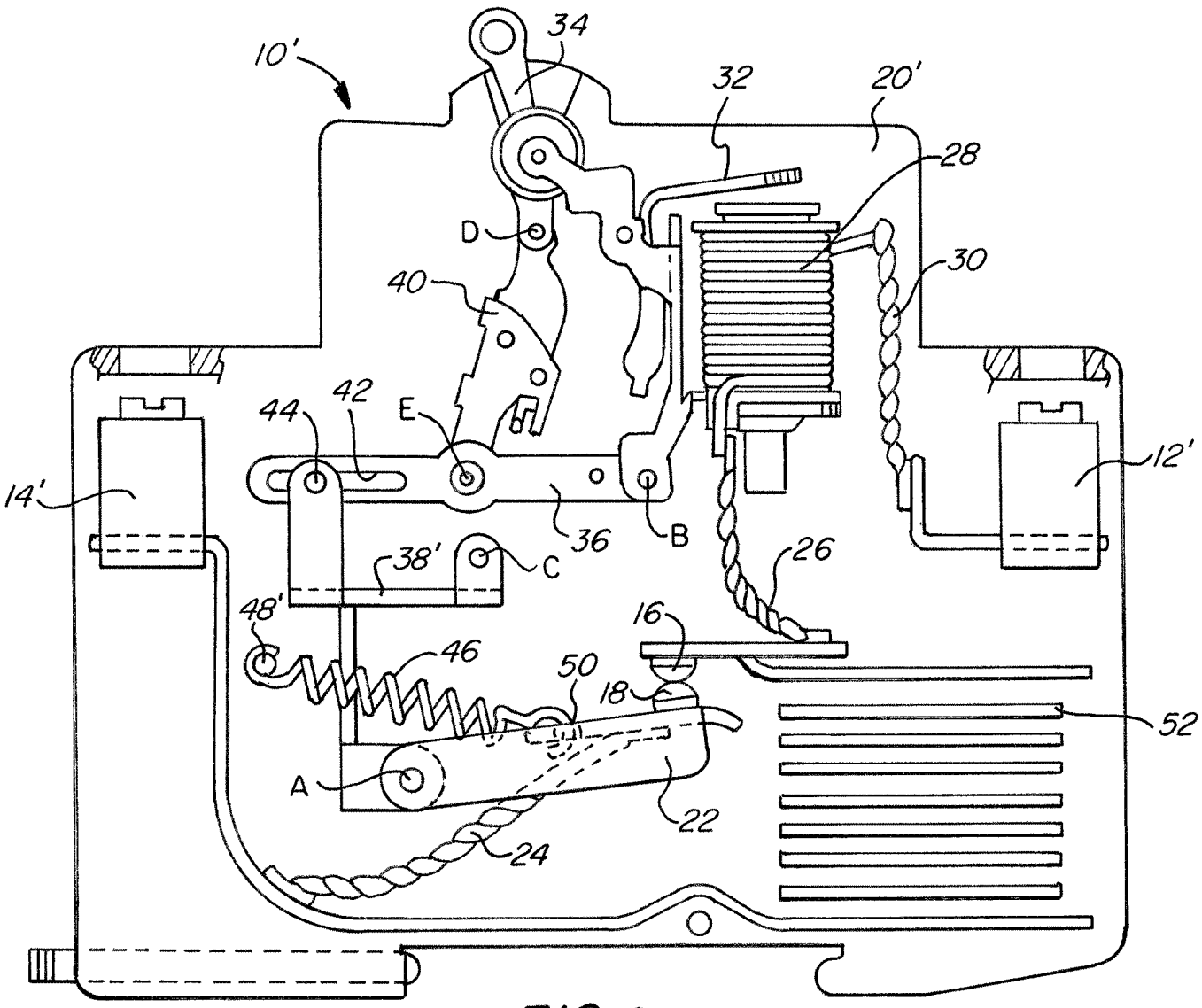
FIG. 3. is a partially cross-sectional side view of a circuit breaker according to an exemplary embodiment of the present invention that operates in very similar fashion as does the circuit breaker of FIG. 1, but which is particularly designed for use in a front mount panel, as opposed to a DIN-rail mount panel, shown with its contacts in a closed, non-tripped state.

Turning now to FIG. 3, the exemplary circuit breaker (10') according to another embodiment of the present invention, particularly configured for use in a front mount panel, is shown in the closed position. The circuit breaker (10') of this embodiment is very similar to the circuit breaker (10) described above in both structure and function, and therefore, a detailed description of this embodiment is not repeated.

As should be apparent to those skilled in the art, one of the most obvious differences between the embodiment (10') and the embodiment (10) is the particular configuration of the housing (20'), as well as the position and configuration of the terminals (12',14'). Various other minor differences are also present, though none materially affect operation of the breaker (10').

One of the main differences between the breaker (10') and that described above is the configuration of the second linkage (38') and the configuration of how the moveable contact arm (22) is attached thereto. However, these differences should be readily apparent from the Figures, and therefore a detailed analysis is not provided. Another difference between the breaker (10') and that described above is the point (48') fixed with respect to the housing (20') at which the biasing member (46) is connected. Again, however, these differences should be readily apparent from the Figures, and therefore a detailed analysis is not provided.

Lastly, due to these differences, the particular angles—i.e., the angle of the moveable contact arm (22) when the contacts (16,18) are in the closed (i.e., "on") state, the angle of the moveable contact arm (22) when the contacts (16,18) are in the open (i.e., "off) state, and the zero-bias angle—are all different than those discussed above with respect to the embodiment shown in FIGS. 1 and 2. However, since the circuit breaker (10') operated in substantially the same way as does the circuit breaker (10) discussed in detail above, more detailed discussion is deemed not to be necessary.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter having a housing within which components of the circuit interrupter are contained, the circuit interrupter comprising:

a line terminal connectable to a source of electrical power;

a load terminal connectable to a load;

a stationary contact being mounted in a fixed fashion with respect to the housing;

a moveable contact arm having a first end and a second end, said moveable contact arm having a moveable contact positioned on the first end and being pivotably connected at the second end with respect to an axis, said moveable contact configured to be pivotable into and out of physical contact with said stationary contact by pivoting of said moveable contact arm about the axis;

wherein, when said moveable contact and said stationary contact are in physical contact, said line terminal and said load terminal are in electrical communication, and when said moveable contact and said stationary contact are out of physical contact, said line terminal and said load terminal are electrically isolated from one another;

wherein said moveable contact arm defines a pivot angle with respect to said housing as said moveable contact arm pivots about the axis; and a tension spring having a first end connected to a point fixed with respect to said housing and having a second end connected to said moveable contact arm, wherein said tension spring exerts a pulling force on said moveable contact arm which pivotally biases said moveable contact toward said stationary contact when the pivot angle is less than a zero-bias angle and exerts a pulling force on said moveable contact arm and which pivotally biases said moveable contact away from said stationary contact when the pivot angle is greater than a zero-bias angle.

2. The circuit interrupter of claim 1 wherein the zero-bias angle comprises the pivot angle of said moveable contact arm with respect to said housing wherein the point fixed with respect to said housing at which said tension spring is connected, the point at which said tension spring is connected to said moveable contact arm and the axis about which said moveable contact arm pivots all lie in a common plane.

3. The circuit interrupter of claim 1 further comprising:

a first linkage having a first end and a second end, the first end of said first linkage being pivotably connected with respect to said housing and said second end having an elongated channel formed therein;

a second linkage having a first end and a second end, the first end of said second linkage being pivotably connected with respect to said housing and said second end having a pin slideably disposed within the elongated channel formed in said first linkage; and wherein the second end of said moveable contact arm is pivotably connected to said second linkage.

4. The circuit interrupter of claim 3 further comprising a handle pivotably connected to said housing, wherein actuation of said handle causes said moveable contact to be pivotable into and out of physical contact with said stationary contact by causing pivoting of said moveable contact arm about the axis about which said moveable contact arm pivots.

5. The circuit interrupter of claim 4 further comprising an escapement mechanism having a first end pivotably connected to said handle and a second end pivotably connected to said first linkage.

6. The circuit interrupter of claim 5 wherein said circuit interrupter comprises a circuit breaker, and further comprising an overcurrent sensor having an armature, wherein upon detection of a fault condition, the armature of the overcurrent sensor causes actuation of said escapement, thereby causing pivoting of said handle, said first linkage, said second linkage and said moveable contact arm to thereby trip the circuit breaker.

7. The circuit interrupter of claim 1 further comprising an arc quenching assembly disposed adjacent to said stationary contact and said moveable contact.

8. A circuit interrupter having a housing within which components of the circuit interrupter are contained, the circuit interrupter comprising:

a line terminal connectable to a source of electrical power;

a load terminal connectable to a load;

a stationary contact being mounted in a fixed fashion with respect to the housing;

a moveable contact arm having a first end and a second end, said moveable contact arm having a moveable contact positioned on the first end and being pivotably connected at the second end with respect to an axis, said moveable contact configured to be pivotable into and out of physical contact with said stationary contact by pivoting of said moveable contact arm about the axis;

wherein, when said moveable contact and said stationary contact are in physical contact, said line terminal and said load terminal are in electrical communication, and when said moveable contact and said stationary contact are out of physical contact, said line terminal and said load terminal are electrically isolated from one another; and a tension spring having a first end connected to a point fixed with respect to said housing and having a second end connected to said moveable contact arm, wherein said tension spring exerts a pulling force on said moveable contact arm, wherein when said moveable contact and said stationary contact are in physical contact, said tension spring pulls said moveable contact toward said stationary contact, and wherein as said moveable contact arm is pivoted so as to move said moveable contact away from said stationary contact, an angular position of said contact arm is reached after which said tension spring pulls said moveable contact away from said stationary contact.

9. The circuit interrupter of claim 8 wherein the angular position of said contact arm after which said tension spring pulls said moveable contact away from said stationary contact as said moveable contact arm is pivoted so as to move said moveable contact away from said stationary contact comprises a zero-bias angle.

10. The circuit interrupter of claim 9 wherein the zero-bias angle comprises the pivot angle of said moveable contact arm with respect to said housing wherein the point fixed with respect to said housing at which said tension spring is connected, the point at which said tension spring is connected to said moveable contact arm and the axis about which said moveable contact arm pivots all lie in a common plane.

11. The circuit interrupter of claim 8 further comprising:

a first linkage having a first end and a second end, the first end of said first linkage being pivotably connected with respect to said housing and said second end having an elongated channel formed therein;

a second linkage having a first end and a second end, the first end of said second linkage being pivotably connected with respect to said housing and said second end having a pin slideably disposed within the elongated channel formed in said first linkage; and wherein the second end of said moveable contact arm is pivotably connected to said second linkage.

12. The circuit interrupter of claim 11 further comprising a handle pivotably connected to said housing, wherein actuation of said handle causes said moveable contact to be pivotable into and out of physical contact with said stationary contact by causing pivoting of said moveable contact arm about the axis about which said moveable contact arm pivots.

13. The circuit interrupter of claim 12 further comprising an escapement mechanism having a first end pivotably connected to said handle and a second end pivotably connected to said first linkage.

14. The circuit interrupter of claim 13 wherein said circuit interrupter comprises a circuit breaker, and further comprising an overcurrent sensor having an armature, wherein upon detection of a fault condition, the armature of the overcurrent sensor causes actuation of said escapement, thereby causing pivoting of said handle, said first linkage, said second linkage and said moveable contact arm to thereby trip the circuit breaker.

15. The circuit interrupter of claim 8 further comprising an arc quenching assembly disposed adjacent to said stationary contact and said moveable contact.

16. A circuit interrupter comprising:

a stationary contact;

a moveable contact disposed on a moveable contact arm;

wherein said moveable contact is configured to be pivotable into and out of physical contact with said stationary contact by pivoting of said moveable contact arm about an axis;

wherein said moveable contact arm defines a pivot angle with respect to said stationary contact as said moveable contact arm pivots about the axis; and a tension spring having a first end connected to a point fixed with respect to said housing and having a second end connected to said moveable contact arm, wherein said tension spring exerts a pulling force on said moveable contact arm which pivotally biases said moveable contact toward said stationary contact when the pivot angle is less than a zero-bias angle and exerts a pulling force on said moveable contact arm and which pivotally biases said moveable contact away from said stationary contact when the pivot angle is greater than a zero-bias angle.

17. The circuit interrupter of claim 16 wherein the zero-bias angle comprises the pivot angle of said moveable contact arm with respect to said stationary contact wherein the point fixed with respect to said housing at which said tension spring is connected, the point at which said tension spring is connected to said moveable contact arm and the axis about which said moveable contact arm pivots all lie in a common plane.

18. A circuit interrupter having a housing within which components of the circuit interrupter are contained, the circuit interrupter comprising:

a line terminal connectable to a source of electrical power;

a load terminal connectable to a load;

a stationary contact being mounted in a fixed fashion with respect to the housing;

a moveable contact arm having a first end and a second end, said moveable contact arm having a moveable contact positioned on the first end and being pivotably connected at the second end with respect to an axis, said moveable contact configured to be pivotable into and out of physical contact with said stationary contact by pivoting of said moveable contact arm about the axis;

wherein, when said moveable contact and said stationary contact are in physical contact, said line terminal and said load terminal are in electrical communication, and when said moveable contact and said stationary contact are out of physical contact, said line terminal and said load terminal are electrically isolated from one another;

wherein said moveable contact arm defines a pivot angle with respect to said housing as said moveable contact arm pivots about the axis;

a biasing member exerting a biasing force on said moveable contact arm which pivotally biases said moveable contact toward said stationary contact when the pivot angle is less than a zero-bias angle and which pivotally biases said moveable contact away from said stationary contact when the pivot angle is greater than a zero-bias angle;

a first linkage having a first end and a second end, the first end of said first linkage being pivotably connected with respect to said housing and said second end having an elongated channel formed therein;

a second linkage having a first end and a second end, the first end of said second linkage being pivotably connected with respect to said housing and said second end having a pin slideably disposed within the elongated channel formed in said first linkage;

wherein the second end of said moveable contact arm is pivotably connected to said second linkage;

a handle pivotably connected to said housing, wherein actuation of said handle causes said moveable contact to be pivotable into and out of physical contact with said stationary contact by causing pivoting of said moveable contact arm about the axis about which said moveable contact arm pivots; and an escapement mechanism having a first end pivotably connected to said handle and a second end pivotably connected to said first linkage.

19. The circuit interrupter of claim 18 wherein said circuit interrupter comprises a circuit breaker, and further comprising an overcurrent sensor having an armature, wherein upon detection of a fault condition, the armature of the overcurrent sensor causes actuation of said escapement, thereby causing pivoting of said handle, said first linkage, said second linkage and said moveable contact arm to thereby trip the circuit breaker.

20. A circuit interrupter having a housing within which components of the circuit interrupter are contained, the circuit interrupter comprising:

a line terminal connectable to a source of electrical power;

a load terminal connectable to a load;

a stationary contact being mounted in a fixed fashion with respect to the housing;

a moveable contact arm having a first end and a second end, said moveable contact arm having a moveable contact positioned on the first end and being pivotably connected at the second end with respect to an axis, said moveable contact configured to be pivotable into and out of physical contact with said stationary contact by pivoting of said moveable contact arm about the axis;

wherein, when said moveable contact and said stationary contact are in physical contact, said line terminal and said load terminal are in electrical communication, and when said moveable contact and said stationary contact are out of physical contact, said line terminal and said load terminal are electrically isolated from one another;

a biasing member exerting a biasing force on said moveable contact arm, wherein when said moveable contact and said stationary contact are in physical contact, said biasing member biases said moveable contact toward said stationary contact, and wherein as said moveable contact arm is pivoted so as to move said moveable contact away from said stationary contact, an angular position of said contact arm is reached after which said biasing member biases said moveable contact away from said stationary contact;

a first linkage having a first end and a second end, the first end of said first linkage being pivotably connected with respect to said housing and said second end having an elongated channel formed therein;

a second linkage having a first end and a second end, the first end of said second linkage being pivotably connected with respect to said housing and said second end having a pin slideably disposed within the elongated channel formed in said first linkage;

wherein the second end of said moveable contact arm is pivotably connected to said second linkage;

a handle pivotably connected to said housing, wherein actuation of said handle causes said moveable contact to be pivotable into and out of physical contact with said stationary contact by causing pivoting of said moveable contact arm about the axis about which said moveable contact arm pivots; and an escapement mechanism having a first end pivotably connected to said handle and a second end pivotably connected to said first linkage.

21. The circuit interrupter of claim 20 wherein said circuit interrupter comprises a circuit breaker, and further comprising an overcurrent sensor having an armature, wherein upon detection of a fault condition, the armature of the overcurrent sensor causes actuation of said escapement, thereby causing pivoting of said handle, said first linkage, said second linkage and said moveable contact arm to thereby trip the circuit breaker.

* * * * *